US007024744B2

(12) United States Patent
Martin et al.

(10) Patent No.: US 7,024,744 B2
(45) Date of Patent: Apr. 11, 2006

(54) FREQUENCY-TUNED COMPRESSOR STATOR BLADE AND RELATED METHOD

(75) Inventors: Nicholas Francis Martin, Simpsonville, SC (US); Thomas Robbins Tipton, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 25 days.

(21) Appl. No.: 10/814,221

(22) Filed: Apr. 1, 2004

(65) Prior Publication Data

US 2005/0220615 A1 Oct. 6, 2005

(51) Int. Cl.
*F01D 9/04* (2006.01)
*F01D 25/06* (2006.01)

(52) U.S. Cl. ..... 29/401.1; 29/407.07; 29/889.23; 29/889.7; 415/119; 415/191; 415/208.1; 415/208.2; 415/209.2; 415/209.3

(58) Field of Classification Search ..... 415/119, 415/191, 208.1, 208.2, 209.3, 209.4, 209.2, 415/210.1; 416/190–192, 248, 500; 29/407.07, 29/401.1, 889.23, 889.7
See application file for complete search history.

(56) References Cited

U.S. PATENT DOCUMENTS 3,326,523 A * 6/1967 Bobo ..... 415/209.3
4,014,627 A * 3/1977 Heurteux ..... 415/209.3
4,118,147 A 10/1978 Ellis
5,022,818 A * 6/1991 Scalzo ..... 415/209.3
5,123,813 A 6/1992 Przytulski et al.
5,429,479 A * 7/1995 Cordier ..... 415/209.3
5,720,597 A 2/1998 Wang et al.
5,931,641 A 8/1999 Finn et al.
5,939,006 A 8/1999 Wang et al.
6,042,338 A 3/2000 Brafford et al.
6,139,278 A 10/2000 Mowbray et al.
6,331,100 B1 12/2001 Liu et al.
6,398,489 B1 6/2002 Burdgick et al.
6,604,285 B1 8/2003 Burdgick et al.
6,607,358 B1 8/2003 Finn et al.

FOREIGN PATENT DOCUMENTS

EP 1 151 123 A2 11/2001

* cited by examiner

*Primary Examiner*—Christopher Verdier
(74) *Attorney, Agent, or Firm*—Nixon & Vanderhye P.C.

(57) ABSTRACT

A method of tuning a compressor stator blade having a base portion and an airfoil portion to achieve a desired natural frequency, includes a) identifying the natural frequency of the compressor stator blade; b) determining a different target natural frequency for the compressor stator blade; and c) removing material from the base portion of the compressor stator blade in an amount and in a configuration that achieves the target natural frequency. A frequency-tuned compressor stator blade includes an airfoil portion and a base portion, the base portion having a substantially solid rectangular shape; and a groove cut across a width dimension of the base portion, the groove having dimensions selected to obtain a predetermined natural frequency for the airfoil portion.

17 Claims, 2 Drawing Sheets

FREQUENCY-TUNED COMPRESSOR STATOR BLADE AND RELATED METHOD

BACKGROUND OF THE INVENTION

This invention relates generally to rotary machine technology and, specifically, to the manufacture or modification of compressor stator blades.

In the past, natural frequency tuning of compressor stator blades has been accomplished by modifying the shape of the airfoil portion of the blade. It would be desirable, however, to be able to modify natural frequency of the airfoil of a compressor stator blade without having to modify the airfoil shape.

BRIEF DESCRIPTION OF THE INVENTION

The present invention relates to a technique for natural frequency tuning of a compressor stator blade without modification of the airfoil portion (or simply, airfoil) of the blade. This technique enables the continued use of a customer's existing compressor stator blades when a need for frequency tuning arises. Alternatively, the frequency tuning technique described herein also may be employed in the manufacture of new compressor stator blades as well.

In an exemplary but non-limiting embodiment of the invention, material is removed from the base or mounting portion of the compressor stator blade via the formation of, for example, a single groove extending fully across the width of the base. It should be understood, however, that the invention is not limited to the formation of a single uniformly shaped groove. For example, multiple grooves could produce the same desired result. In addition, the depth and/or width of the one or more grooves may also vary. Thus, by the judicious removal of material in the stator blade base or mounting portion, the foundation stiffness of the airfoil portion of the blade is changed, which in turn also changes the natural frequency of the airfoil.

Accordingly, in its broader aspects, we have provided a method of tuning a compressor stator blade, having a base portion and an airfoil portion, to achieve a desired natural frequency, comprising a) identifying the natural frequency of the compressor stator blade; b) determining a different target natural frequency for the compressor stator blade; and c) removing material from the base portion of the compressor stator blade in an amount and in a configuration that achieves the target natural frequency.

In another aspect, we have provided a method of tuning a compressor stator blade so as to achieve a desired natural frequency, wherein the stator blade has an airfoil portion and a base portion that is substantially rectangular, with a pair of relatively longer side surfaces, a pair of relatively shorter end surfaces' a top surface and a bottom surface; the method comprising a) identifying the natural frequency of the compressor stator blade; b) determining a different target natural frequency for the compressor stator blade; and c) removing material from the base portion of the compressor stator blade in the form of a groove that is shaped to achieve the target natural frequency.

In still another aspect, we have provided a compressor stator blade comprising an airfoil portion and a base portion, the base portion having a substantially solid rectangular shape; and at least one groove cut across a width dimension of the base portion, the groove having dimensions selected to obtain a predetermined natural frequency for the airfoil portion.

The invention will now be described in detail in connection with the drawings identified below.

DETAILED DESCRIPTION OF THE INVENTION

Figure 1:
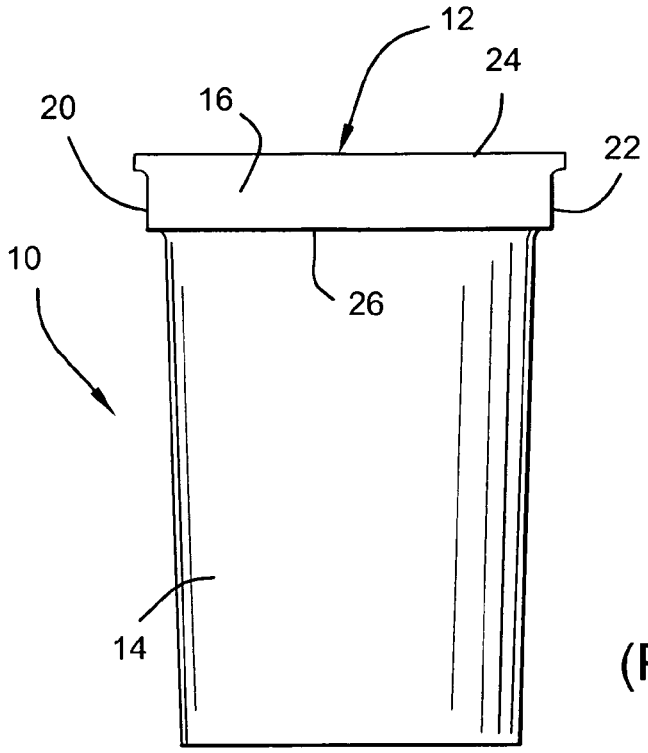
Fig. 1 (Prior Art)
FIG. 1 is a side elevation of a known compressor stator airfoil.
Figure 2:
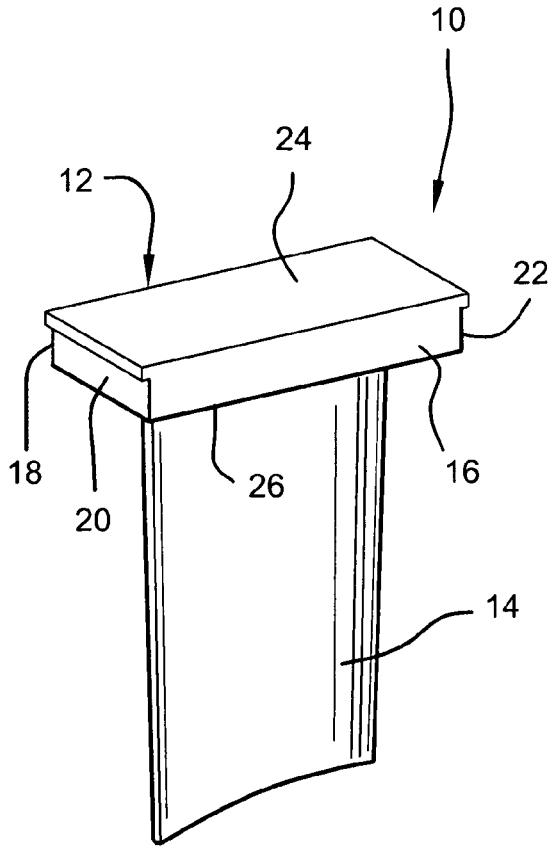
Fig. 2 (Prior Art)
FIG. 2 is a perspective view of the airfoil shown in FIG. 1.

With reference initially to FIGS. 1 and 2, a known compressor stator blade 10 includes a base or mounting portion 12 and an airfoil portion 14. The base or mounting portion 12 is generally rectangular in shape, with a pair of longer side surfaces 16, 18 and a pair of shorter end surfaces 20, 22 along with a radially inner surface 24 and a radially outer surface 26. The base portion may also be formed in the shape of a parallelogram, i.e., where the parallel end surfaces are not perpendicular to the parallel side surfaces. In the past, to alter the natural frequency of the airfoil portion 14, the shape of the airfoil itself had to be modified.

Figure 3:
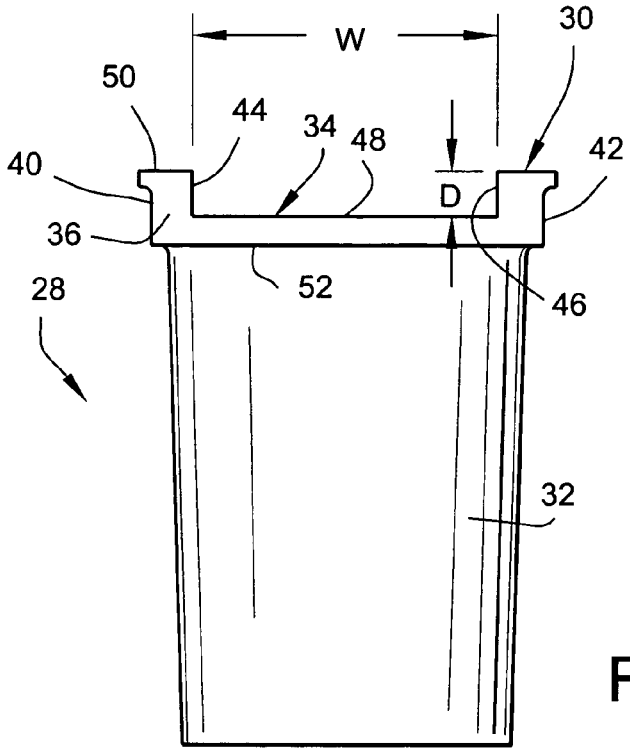
FIG. 3 is a side elevation of a compressor airfoil in accordance with a non-limiting embodiment of the invention.
Figure 4:
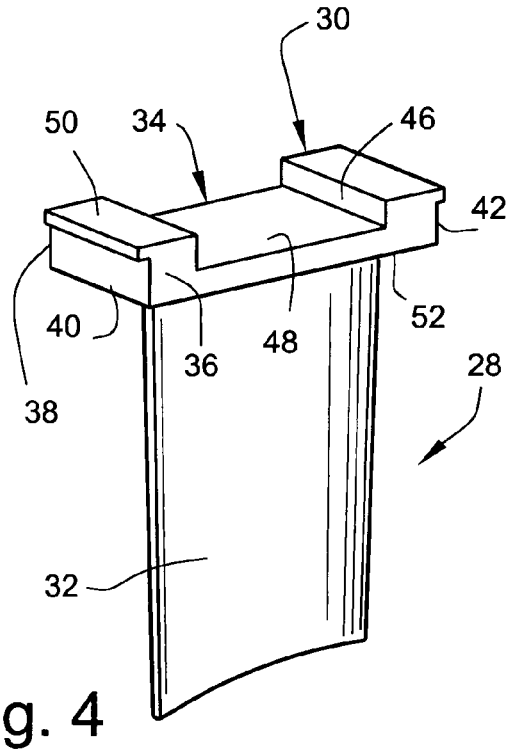
FIG. 4 is a perspective view of the airfoil shown in FIG. 3.

FIGS. 3 and 4 illustrate a compressor stator blade in accordance with a non-limiting exemplary embodiment of the invention. In this embodiment, the compressor stator blade 28 also includes a base or mounting portion 30 and an airfoil portion 32. After having determined the natural frequency of the blade and after having identified a target natural frequency, the stator blade is modified by selectively removing material from the base or mounting portion 30. Specifically, a single wide groove 34 has been formed in the base or mounting portion by cutting or machining, the groove extending completely across the width of the base or mounting portion, i.e., from side surface 36 to side surface 38, parallel to end surfaces 40, 42. It can be seen that the width of the groove substantially spans the entire chord length of the airfoil portion 32. In this case, the groove 34 has parallel or substantially parallel side surfaces 44, 46 and a flat or substantially flat base or base surface 48. Base surface 48 is parallel to radially inner surface 50 and radially outer surface 52 of the base or mounting portion 30. Thus the groove is shown to have a constant width and constant depth.

It will be appreciated by those skilled in the art that the amount of material removed from the base or mounting portion is dependent upon the desired natural frequency. Thus, the width "W" of the groove and the depth "D" of the groove may be altered as necessary to achieve the targeted natural frequency. In addition, the sides 44, 46 of the groove 34 need not be straight or parallel, and the depth "D" of the groove may also vary across the flat base 48 of the groove. For example, surfaces 44, 46 may be oppositely curved (either convex or concave), and the depth D may vary linearly or non-linearly across the length and/or width of the groove. The desired frequency may also be achieved by forming one or more additional grooves of the same or different size and shape.

The removal of material from the stator blade base or mounting portion for purposes of tuning the natural frequency of the airfoil is a concept that may not only be retrofitted into existing compressor stator blades, but also used in the initial design and manufacture of compressor stator blades. The ability to utilize the invention in existing compressor stator blades provides a relatively quick hardware solution to a frequency related issue as compared to the normal cycle for the production of a new stator blade with a modified airfoil shape.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of tuning a compressor stator blade, having a base portion and an airfoil portion, to achieve a desired natural frequency, comprising:

a) identifying the natural frequency of the compressor stator blade;

b) determining a different target natural frequency for the compressor stator blade; and c) removing material from the base portion of the compressor stator blade in an amount and in a configuration that achieves the target natural frequency.

2. The method of claim 1 wherein step c) is carried out by forming at least one groove in the base portion.

3. The method of claim 2 wherein said groove has substantially parallel sides and a substantially flat base.

4. The method of claim 3 wherein said groove has a constant depth.

5. The method of claim 3 wherein said groove has a constant width.

6. The method of claim 3 wherein said groove has a constant depth and a constant width.

7. The method of claim 2 wherein said groove extends fully across the width of the base portion.

8. The method of claim 1 wherein said base portion is substantially rectangular, with a pair of relatively longer side surfaces, a pair of relatively shorter end surfaces, a radially inner surface and a radially outer surface.

9. The method of claim 8 wherein step c) is carried out by forming at least one groove in the base portion.

10. The method of claim 9 wherein said groove extends entirely across said base portion from one side surface to the other side surface.

11. A method of tuning a compressor stator blade so as to achieve a desired natural frequency, wherein the stator blade has an airfoil portion and a base portion that is substantially rectangular, with a pair of relatively longer side surfaces, a pair of relatively shorter end surfaces' a radially inner surface and a radially outer surface; the method comprising:

a) identifying the natural frequency of the compressor stator blade;

b) determining a different target natural frequency for the compressor stator blade; and c) removing material from the base portion of the compressor stator blade in the form of at least one groove that is shaped to achieve the target natural frequency.

12. The method of claim 11 wherein said groove has substantially parallel sides and a substantially flat base surface.

13. The method of claim 11 wherein said groove has a constant depth.

14. The method of claim 12 wherein said groove has a constant width.

15. The method of claim 11 wherein said groove extends fully across the width of the base portion.

16. The method of claim 11 wherein said groove has a constant depth and a constant width.

17. The method of claim 11 wherein said groove extends completely across a width dimension of said base portion from one longer side surface to the other longer side surface.

* * * * *